US005230675A

United States Patent [19]

Lin

[11] Patent Number: 5,230,675

[45] Date of Patent: Jul. 27, 1993

[54] GYMNASTIC PEDALLING APPARATUS

[75] Inventor: C-D Lin, Kuang Hua Village, Taiwan

[73] Assignee: Vichy Industrial Co., Ltd., Taichung Hsien, Taiwan

[21] Appl. No.: 981,499

[22] Filed: Nov. 25, 1992

[51] Int. Cl.[5] ..... A63B 22/04

[52] U.S. Cl. ..... 482/53; 482/80

[58] Field of Search ..... 482/51, 52, 53, 79, 482/80

[56] References Cited

U.S. PATENT DOCUMENTS 3,316,898 5/1967 Brown ..... 482/52

5,076,572 12/1991 Wang ..... 482/53

FOREIGN PATENT DOCUMENTS 0073744 3/1983 European Pat. Off. ..... 482/79

*Primary Examiner*—Stephen R. Crow

*Attorney, Agent, or Firm*—Browdy and Neimark

[57] ABSTRACT

A gymnastic pedalling apparatus comprising a base frame, a front board fastened to the base frame, a base board fastened to the base frame and situated behind the front board, two long bars pivoted coaxially to the front board, two pedals fastened respectively to free ends of the two long bars, two hydraulic cylinders pivoted to base frame and the two long bars, a lifting board pivoted to the base board, a threaded rod having one end fastened to the lifting board and having another end penetrating through the top of the base board, a nut screwed onto the threaded rod in a manner that the nut remains over the top of the base board for adjusting the height of the lifting board, a sleeve fastened horizontally at the bottom portion of the lifting board, a rotating shaft fitted into the sleeve, a long support arm and a short support arm fastened respectively to the rotating shaft, and two rollers pivoted respectively to the free ends of the two support arms and situated respectively under the two long bars.

2 Claims, 4 Drawing Sheets

GYMNASTIC PEDALLING APPARATUS

BACKGROUND OF THE INVENTION

The present invention relates to an exercise apparatus, and more particularly to a pedalling apparatus for use in exercise.

The prior art gymnastic pedalling apparatus and the prior art gymnastic apparatus providing a cliff-climbing animation have a shortcoming in common. In other words, they are rather cumbersome in volume and are therefore difficult to be moved around. In addition, they take up too much of space and are therefore not suitable for use in a small private home, in which a space sufficiently large to accommodate such cumbersome gymnastic apparatus is hard to come by. As a result, such prior art gymnastic devices, as mentioned above, are generally used only in a gymnasium. The prior art pedalling apparatus is further limited in that it has a fixed pedalling range, which can not be adjusted to accommodate the body size of a user of the apparatus. In other words, a person with extra short or long legs would find it rather awkward to do a pedalling exercise on such prior art exercise device.

SUMMARY OF THE INVENTION

It is, therefore, the primary objective of the present invention to provide a gymnastic pedalling apparatus, which is small in volume and is therefore suitable for use in places such as an office, a hotel room, a small private home, etc. Such pedalling apparatus can be moved around easily and put up for storage conveniently.

It is another objective of the present invention to provide a gymnastic pedalling apparatus with an adjustable pedalling range to accommodate the users having various body sizes.

In keeping with the principles of the present invention, the foregoing objectives of the present invention are accomplished by a gymnastic pedalling apparatus, which comprises a bottom frame, a front board fastened to the front end of the bottom frame, a base board mounted on the bottom frame in a manner that it is situated behind the front board, two long bars pivoted respectively and coaxially to the front board in such a way that they can swing upwards and downwards, two pedals fastened respectively to the free ends of the long bars, two hydraulic cylinders with one end pivoted to the bottom frame and with another end pivoted to the long bars, a lifting board pivoted to the base board in a manner that the lifting board is capable of making an up-and-down motion, a threaded rod with one end pivoted to the lifting board and with another end penetrating the top of the base board to emerge outside the top of the base board, a nut screwed onto the threaded rod in a manner that the nut sits on the top of the base board for adjusting and controlling the height of the lifting board, a sleeve fastened horizontally to the bottom of the lifting board, a rotating shaft fitted pivotally into the sleeve, a long support arm fastened at one end thereof to one end of the rotating shaft and a short support arm fastened at one end thereof to another end of the rotating shaft, and two rollers pivoted respectively to the free ends of the two support arms in a manner that the two rollers are situated under the two long bars to which the two rollers can be fastened.

DETAILED DESCRIPTION OF THE PREFERRED EMBODIMENT

Figure 1:
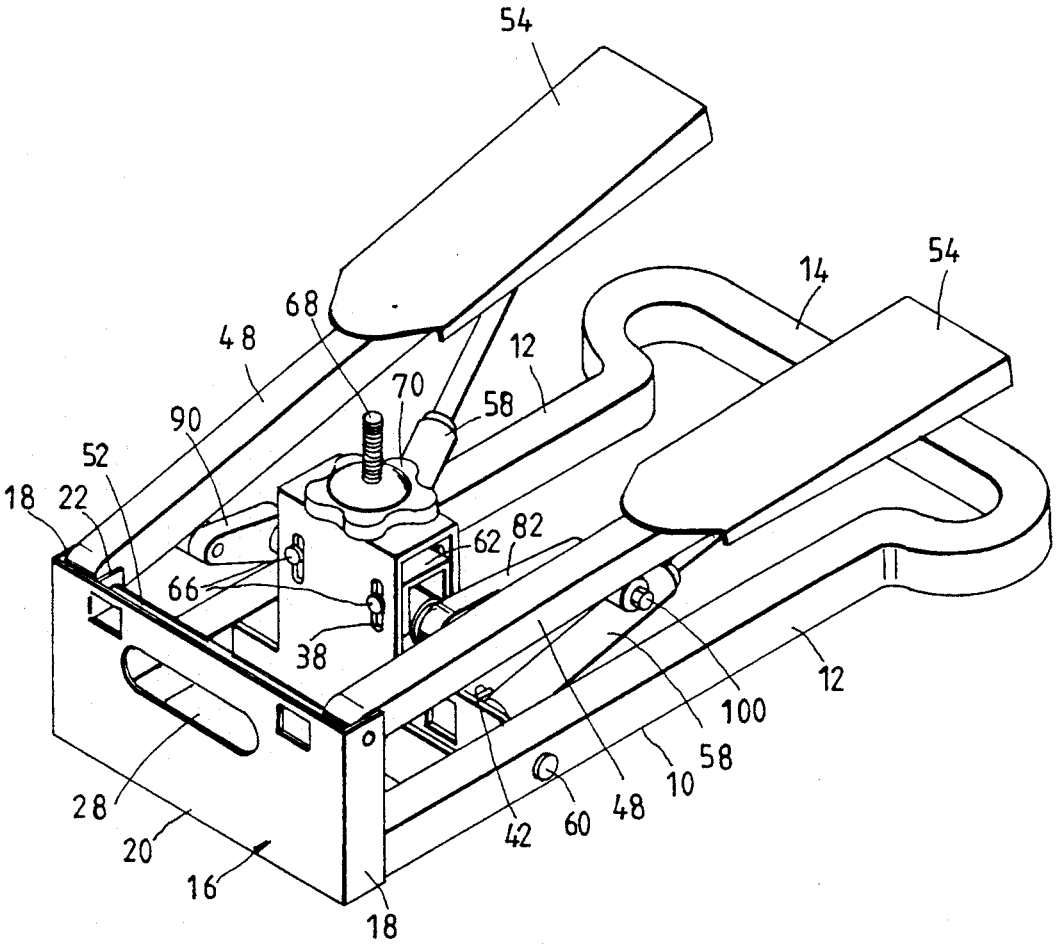
FIG. 1 shows a perspective view of the present invention.
Figure 2:
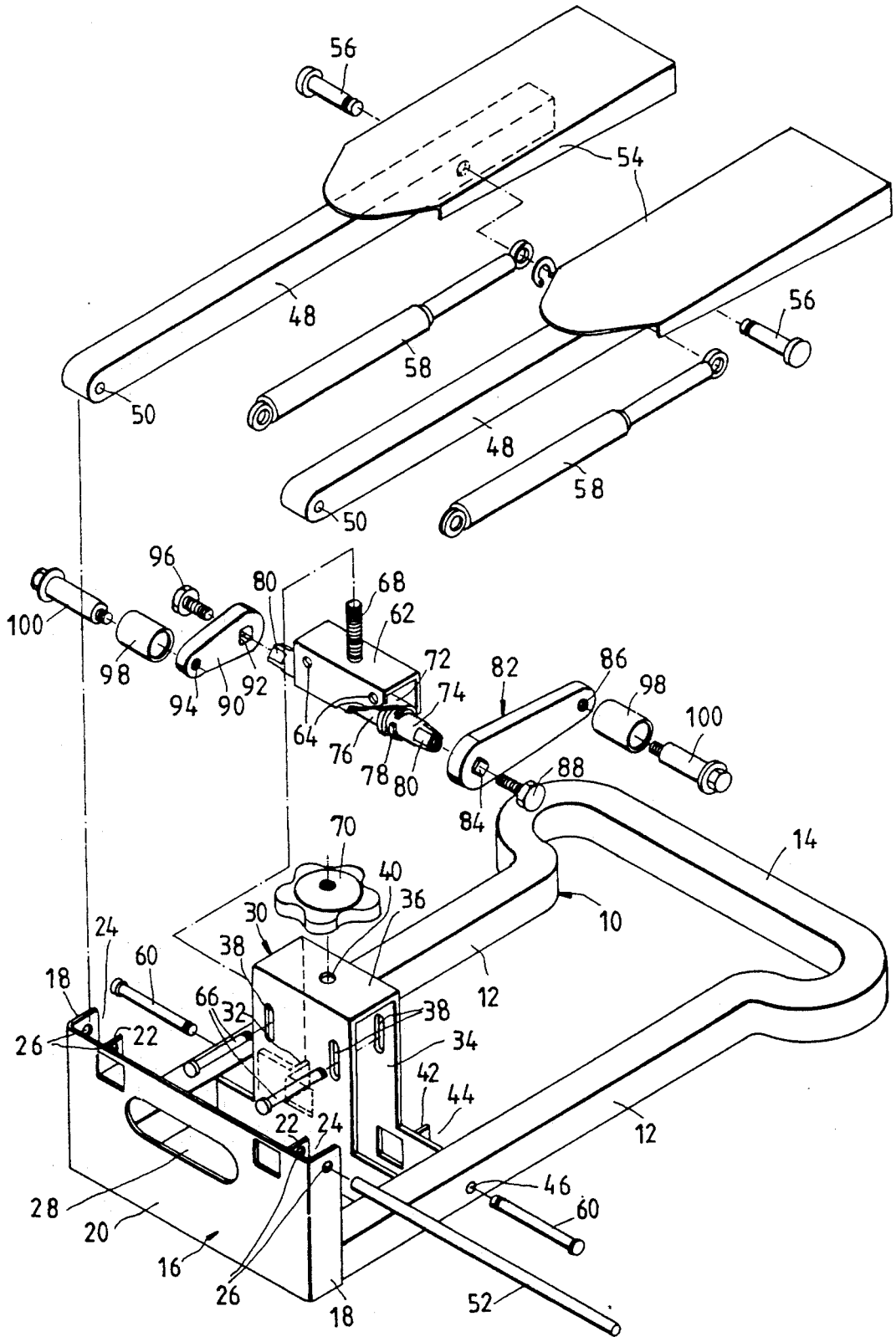
FIG. 2 shows an exploded view of the present invention.

Referring to all drawings provided herewith, a gymnastic pedalling apparatus of the present invention is shown to comprise the structures, which are described hereinafter.

A bottom frame 10 has two arm portions 12 parallel to each other, with each of the two arm portions 12 having a rear end that is coupled with an oval tail portion 14.

A front board 16 is fastened to the front ends of the two arm portions 12 of the bottom frame 10 and is slightly of a U-shaped construction. The front board 16 has two shoulders 18. The front surface 20 of the front board 16 is punched to form two lugs 22 in the rear side of the front board 16. Each of the two lugs 22 and the corresponding shoulder 18 form a pivoting portion 24 comprising two through holes 26 which are punched coaxially and respectively through the shoulder 18 and the lug 22. The front surface 20 of the front board 16 is provided with an elongate oval hole 28 so dimensioned as to facilitate a person's hand to grab the front board 16 to move the pedalling apparatus.

A base board 30 has a front wall 32 and a rear wall 34, which are parallel to each other, and a top wall 36. The front wall 32 is provided with two elongate holes 38, which are corresponding in location to the two elongate holes 38 of the rear wall 34. The top wall 36 is provided with a circular through hole 40. Located at the lower end of the rear wall 34 are two lugs 42 (only one lug 42 is seen in the drawings.) The base board 30 is fastened to the two arm portions 12 of the bottom frame 10 and is situated behind the front board 16. Each of the two lugs 42 and each of the two arm portions 12 form therebetween a pivoting portion 44 comprising two through holes 46 punched coaxially through the lug 42 and the arm portion 12.

Each of two long bars 48 is provided with a through hole 50 located at front end which is mounted in the pivoting portion 24 of the front board 16 by means of a shaft 52 passing through the through holes 26 and 50. In other words, each of the two long bars 48 is mounted pivotally on the shaft 52, which is in turn fastened to the shoulder 18 of the front board 16.

Two pedals 54 are fastened respectively to the rear ends of the two long bars 48 by means of two shaft pins 56.

Each of two hydraulic cylinders 58 has a front end that is mounted pivotally in the pivoting portion 44 by means of a cotter pin 60 which is put through the through hole 46. The rear end of each of the two hydraulic cylinders 58 is pivoted to the shaft pin 56.

A lifting board 62 of a U-shaped construction has two parallel walls, each of which is provided with a through hole 64. The lifting board 62 is mounted inside the base board 30 by means of two bolts 66 which are put through the elongate holes 38 and the through holes 64. The lifting board 62 is capable of making an up-and-down movement only in an axial direction of the elongate hole 38.

A threaded rod 68 is fastened at one end thereof to the top wall of the lifting board 68 and is provided with another end that is put through the through hole 40 of the base board 30.

A nut 70 is screwed onto the threaded rod 68 in a manner that the nut 70 remains over the top wall 36 of the base board 30. As a result, the height of the lifting board 62 can be adjusted.

A sleeve 72 is welded to the lower portion of the lifting board 62.

A rotating shaft 74 is fitted into an axial hole 76 of the sleeve 72. Two rings 78 are welded respectively to both ends of the axial hole 76. Both ends of the rotating shaft 74 are provided with polygonal fastening portions 80.

A long support arm 82 has a front end provided with a polygonal receiving hole 84 and has a rear end provided with a threaded hole 86. The polygonal fastening portion 80 of the rotating shaft 74 is fitted into the polygonal receiving hole 84. A bolt 88 is used to help hold together the rotating shaft 74 and the long support arm 82. The free end of the bolt 88 faces the rear end of the bottom frame 10.

A short support arm 90 has a rear end provided with a polygonal receiving hole 92 and has a front end provided with a threaded hole 94. The polygonal fastening portion 80 of the rotating shaft 74 is fitted into the polygonal receiving hole 92. A bolt 96 is used to help hold together the rotating shaft 74 and the short support arm 90. The free end of the bolt 96 faces the front board 16 and forms with the long support arm 82 an upward angle of 15 degrees.

Two rollers 98 of a rubber material are pivoted respectively to the threaded holes 86 and 94 of the long and the short support arms 82 and 90 by means of two bolts 100. The two rollers 98 are situated under the two long bars 48.

Figure 3:
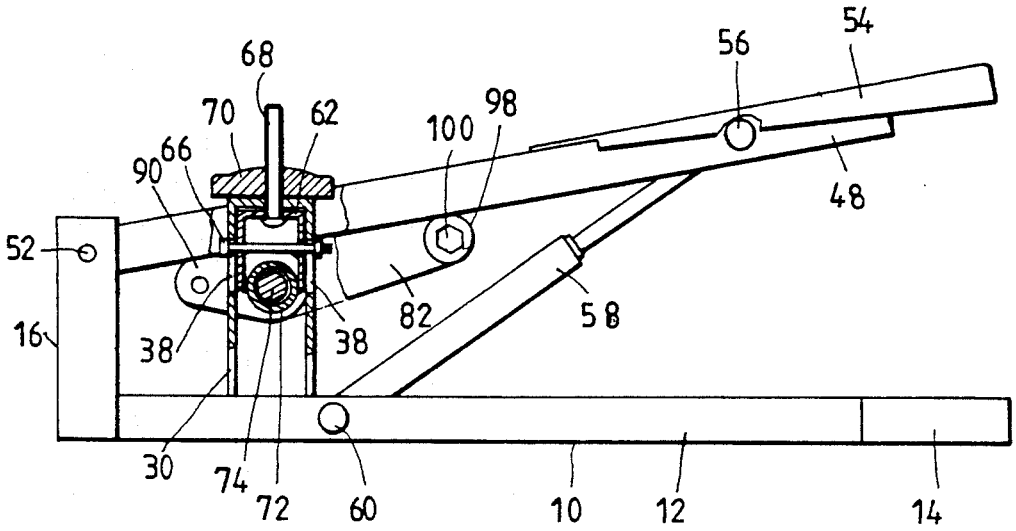
FIG. 3 shows a partial sectional view of the present invention.

As shown in FIG. 3, the short support arm 90 remains at a horizontal position when two pedals 54 are positioned at the same level, with the long support arm 82 remaining at an angle of elevation of 15 degrees. The front long bar 48 is fastened with the roller 98 pivoted to the free end of the long support arm 82, while the rear long bar 48' is fastened with the roller 98' pivoted to the free end of the short support arm 90.

Figure 4:
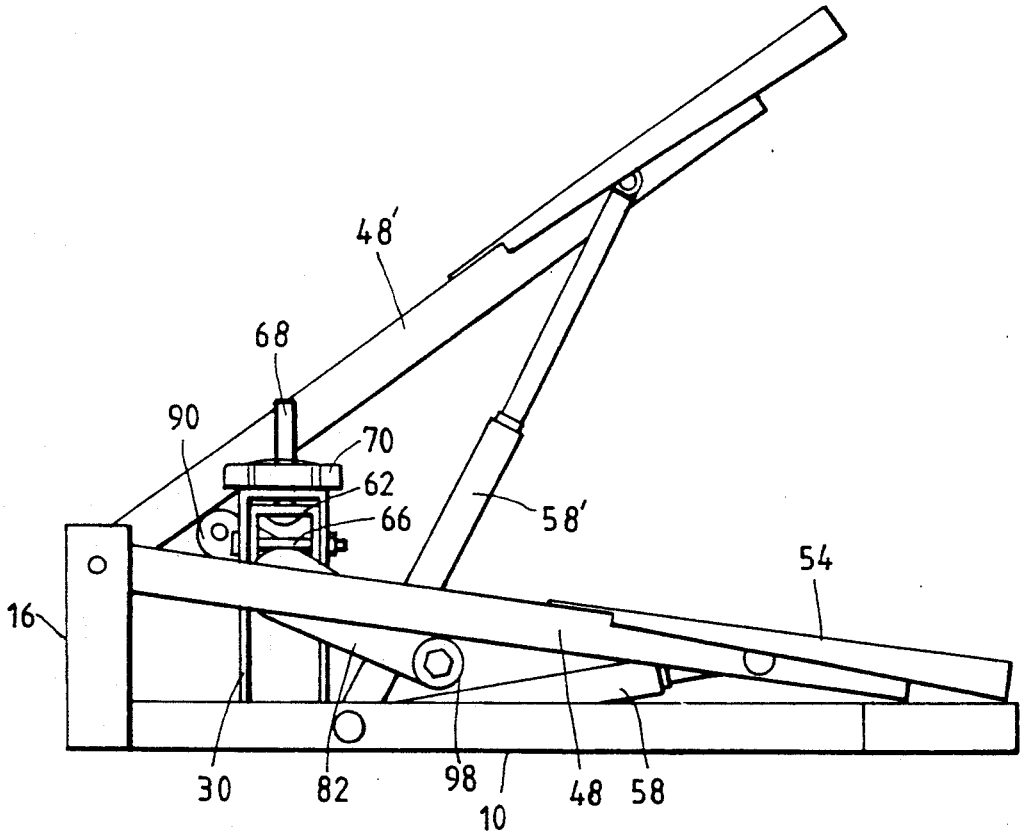
FIGS. 4 and 5 show schematic views of the present invention at work.

As illustrated in FIG. 4, when the left foot of a user, who faces the front board 16, steps down forcefully to cause the front long arm 48 to move downward, the hydraulic cylinder 58 is made more compact by pressure. As a result, the long support arm 82 moves downwards to trigger the upward movement of the short support arm 90, which causes the rear long arm 48' to rise so as to make another hydraulic cylinder 58' to expand. Therefore, the right foot of the user is caused to rise.

Figure 5:
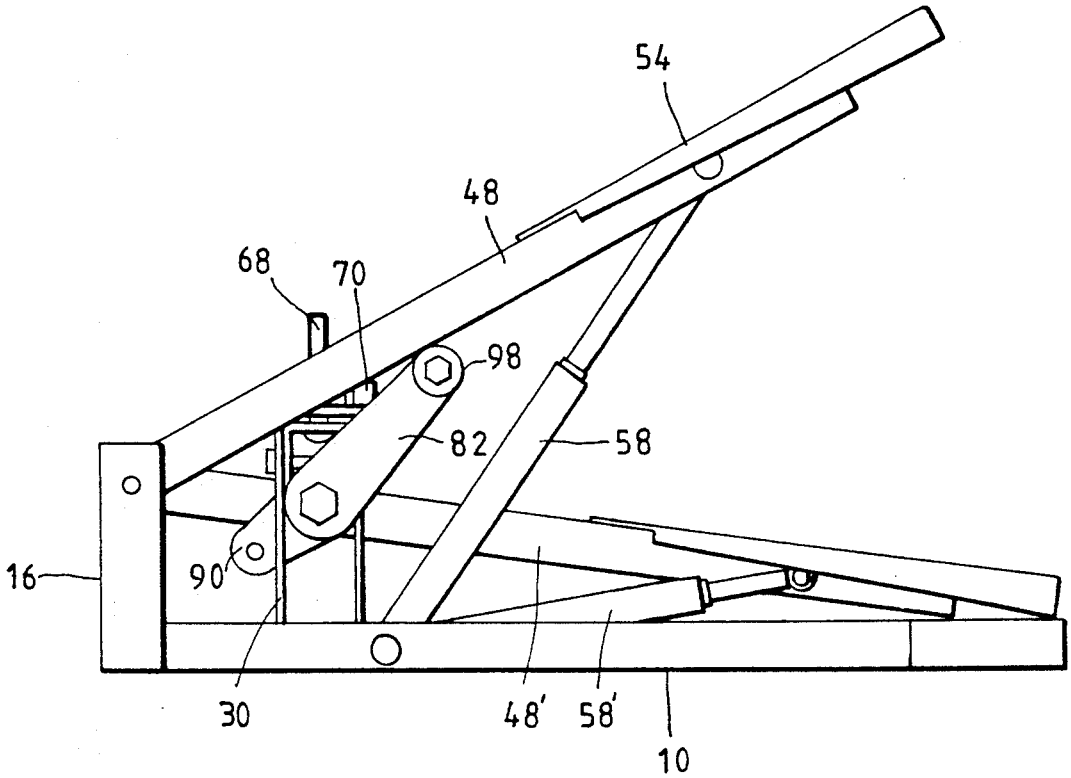

Now referring to FIG. 5, it is seen that the right foot of the user steps down forcefully to cause the rear long bar 48' to move downwards, thereby resulting in the hydraulic cylinder 58' to compress so as to make the short support arm 90 to move downward. As a result, the long support arm 82 is caused to rise to trigger the front long bar 48 to rise. In the meantime, the hydraulic cylinder 58 is made to expand so as to cause the left foot of the user to rise.

The motions of the left foot and the right foot of the user, as described above, are so repeated that the user is able to attain the objective of building the muscles of both legs.

Figure 6:
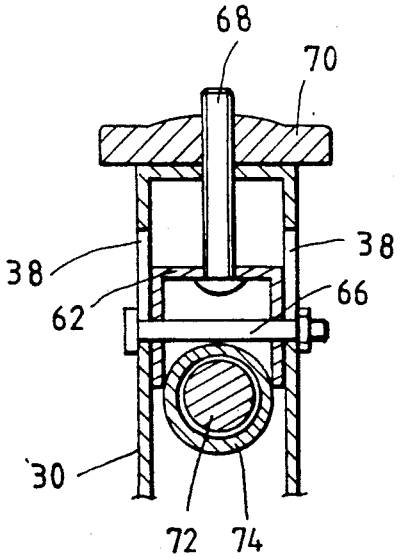
FIG. 6 is a partial enlarged sectional view of the present invention, showing the condition under which the lifting board is adjusted.

As shown FIG. 6, the user can adjust easily the height of the lifting board 62 by turning the nut 70 to change the moving ranges of the long and the short support arms 82 and 90. As a result, the range within which the two pedals 54 are made to move upwards and downwards can be made greater by moving the lifting board 62 upwards, and smaller by moving the lifting board 62 downwards. Therefore, the gymnastic pedalling apparatus of the present invention is suitable for use by persons of various heights.

What is claimed is:

1. A gymnastic pedalling apparatus, comprising:

a base frame having two arm portions parallel to each other;

a front board fastened to said two arm portions;

a base board having front and rear walls parallel to each other and having a top wall connecting with said front and rear walls, with said top wall provided with a through hole, and with said front and rear walls provided respectively with two elongate holes, said base board being fastened to said two arm portions and situated behind said front board;

two long bars pivoted coaxially to said front board in a manner that said two long bars are capable of swinging upwards and downwards;

two pedals, each of which is fastened to a free end of one of said two long bars;

two hydraulic cylinders, each of which has an end that is pivoted to one of said two arm portions, and each of which has another end that is pivoted to one of said two long bars;

a lifting board having two walls parallel to each other, with each of said two walls provided with two through holes arranged coaxially, said lifting board being mounted in said base board by means of two bolts which are put through said through holes and said elongate holes of said base board, thereby making said lifting board capable of making an up-and-down movement along an axial direction of said elongate hole;

a threaded rod having an end that is fastened to a top wall of said lifting board and having another end that is put through said through hole of said top wall of said base board;

a nut screwed onto said threaded rod in a manner that said nut is situated over said top wall of said base board;

a sleeve fastened horizontally at a lower portion of said lifting board;

a rotating shaft fitted into an axial hole of said sleeve;

a long support arm having an end that is fastened to said rotating shaft and having another end that faces a rear end of said base frame;

a short support arm having an end that is fastened to said rotating shaft and having another end that faces said front board; and two rollers pivoted respectively to said another end of said long support arm and to said another end of said short support arm in a manner that said two rollers are situated respectively under said two long bars.

2. The gymnastic pedalling apparatus of claim 1 wherein said long support arm and said short support arm form an upward angle of 15 degrees.

* * * * *